US005293657A

United States Patent [19]

DeAth

[11] Patent Number: 5,293,657

[45] Date of Patent: Mar. 15, 1994

[54] SUSPENSION DEVICE FOR HAMMOCKS AND OTHER OBJECTS

[76] Inventor: S. Samuel DeAth, R.R. #2, Campbellville, Ontario, Canada, L0P 1B0

[21] Appl. No.: 867

[22] Filed: Jan. 5, 1993

[51] Int. Cl.[5] ..... A45F 3/24

[52] U.S. Cl. ..... 5/127; 5/120; 182/9; 248/231; 248/218.4

[58] Field of Search ..... 5/120, 122, 123, 127; 248/231, 218.4; 182/9, 187

[56] References Cited

U.S. PATENT DOCUMENTS

| | | | |
|---|---|---|---|
| 1,721,516 | 7/1929 | Jacobs | 182/9 |
| 3,840,091 | 10/1974 | Conlon | 182/9 |
| 4,397,500 | 8/1983 | Moffitt | 182/187 X |
| 4,722,421 | 2/1988 | Hilbert | 182/187 |
| 5,141,074 | 8/1992 | Sulowski et al. | 182/9 |

FOREIGN PATENT DOCUMENTS 809322 12/1936 France ..... 5/122

*Primary Examiner*—Michael F. Trettel
*Attorney, Agent, or Firm*—Bereskin & Parr

[57] ABSTRACT

The present invention relates to a suspension device for suspending objects such as a hammock, tarpaulin or any object requiring slip-free suspension from one or more load bearing members. The invention consists of a gripping belt of determinate length to fit around the load bearing member, having a buckle on the line for releasably cinching the belt around the member, a spanning belt having a closure device for selectively spanning the distance between the member and the article, a pair of belt loops or other couplers for releasably coupling the spanning belt to the gripping belt around the member at least at one tension point, and a securing device to secure the spanning belt to the article to be suspended.

8 Claims, 2 Drawing Sheets

SUSPENSION DEVICE FOR HAMMOCKS AND OTHER OBJECTS

BACKGROUND OF THE INVENTION

There are many situations in one's backyard, while camping, or on a farm where it is desirable or necessary to suspend something above the ground. In the backyard it would be convenient to be able to set up a hammock to relax in that does not require damaging the supporting members or making complicated knots. While camping, canopies are needed over cooking areas and temporary clotheslines may be necessary to hang wet clothes. On a farm one often needs to rig up tarpauline covers for tractors or other machinery. A common difficulty in all of these scenarios is the desire or the need to suspend something above the ground. In the past, to suspend a hammock or a canopy above the ground one has had to resort to ropes and a crude knowledge of knots. This has often met with much frustration. It is time consuming to set up such temporary structures, the knots are either too loose and give way under strain, or they are too tight and can never be undone. Such wastes of time and aggravation are now a thing of the past with the suspension device of the subject invention.

This invention relates to a suspension device which can be used to suspend an object such as a hammock or the like. Hammocks are typically suspended by chains or ropes from hooks anchored in trees or posts or other such load bearing members; this creates several problems. First, if the trees, posts or boughs to which the hammock is fastened to are further apart than the length of the hammock, then chains or ropes must be used and to bring such equipment along for temporary hammock setups is cumbersome and heavy. Second, the hooks used to suspend the hammock must be securely anchored, and this often entails nailing, screwing or some other such fastening which cannot be easily or quickly removed without special tools. The use of such hooks damages the trees or posts, is time consuming to install and take down. Further it is of a semi-permanent nature and as a practice does not lend itself well to setting up hammocks during camping trips, an afternoon in the park and so on.

Some attempts have been made in the past to introduce a better hammock suspension device. U.S. Pat. No. 399,928, dated Mar. 19, 1898, granted to Pritchard for a "Hammock-Suspension Device," discloses a metal device that is cinched or bolted to the tree or post, wherein the hammock is attached to the front hook. This system has three disadvantages. First, the location that the hammock can be placed in is still limited by the length of the hammock and the space between the members that will support its suspension. Second, due to the metal construction of the "hammock-hook," the bracket that rests against the tree or post is not malleable and hence unable to accommodate very large or very small trees or posts. Third, the design of the device transfers the load in the hammock to bear directly on the hook, thus creating a significant weak point.

U.S. Pat. No. 3,030,160, dated Apr. 17, 1962, granted to Tandy for a "Hanging Table," discloses a suspension device used to suspend a table. It consists of a belt and buckle and two support arms that can hook onto the belt. If the suspension system was used to suspend hammocks it would have three disadvantages. First, the support arms would be heavy and cumbersome to carry about. Second, the set-up location of the hammock would still be limited greatly by the length of the hammock. Third, this device also transfers the load to bear directly on the hooks, thus creating a significant weak point and stressing the belt.

It is desirable to have a portable hammock suspension system that is able to support a hammock between one or more members over a wide range without the use of chains, is quick to set up, light weight and secures the hammock to the objects with little slippage, does not damage the load bearing members and is secure. The present invention relates to a hammock suspension system that meets these needs.

SUMMARY OF THE INVENTION

The principal objective of this invention is to provide a suspension device that can suspend a variety of objects from a variety of load bearing members. Such a device should have little or no slippage so that the load will not settle under strain. It is also an important objective to provide a simple mechanism to accomplish the principal objective.

The subject invention comprises a suspension device for suspending an article from a load bearing member, comprising a gripping means for gripping the load bearing member, spanning means for spanning the distance between the member and the article, belt coupling means for releasably coupling the spanning means to the gripping means around the member at a minimum of one tension point, and securing means for securing the spanning belt to the article to be suspended.

The gripping means preferrably comprises a gripping belt of determinate length to fit around the load bearing member and cinching means for releasably cinching the belt around the load bearing member. The belt coupling means preferably comprises a pair of belt loops dimensioned to be received on the gripping belt and slideably receive the spanning means.

BRIEF DESCRIPTION OF THE DRAWINGS

The invention will now be described by way of example only, with reference to the following drawings, in which.

DETAILED DESCRIPTION OF THE PREFERRED EMBODIMENTS

Figure 1:
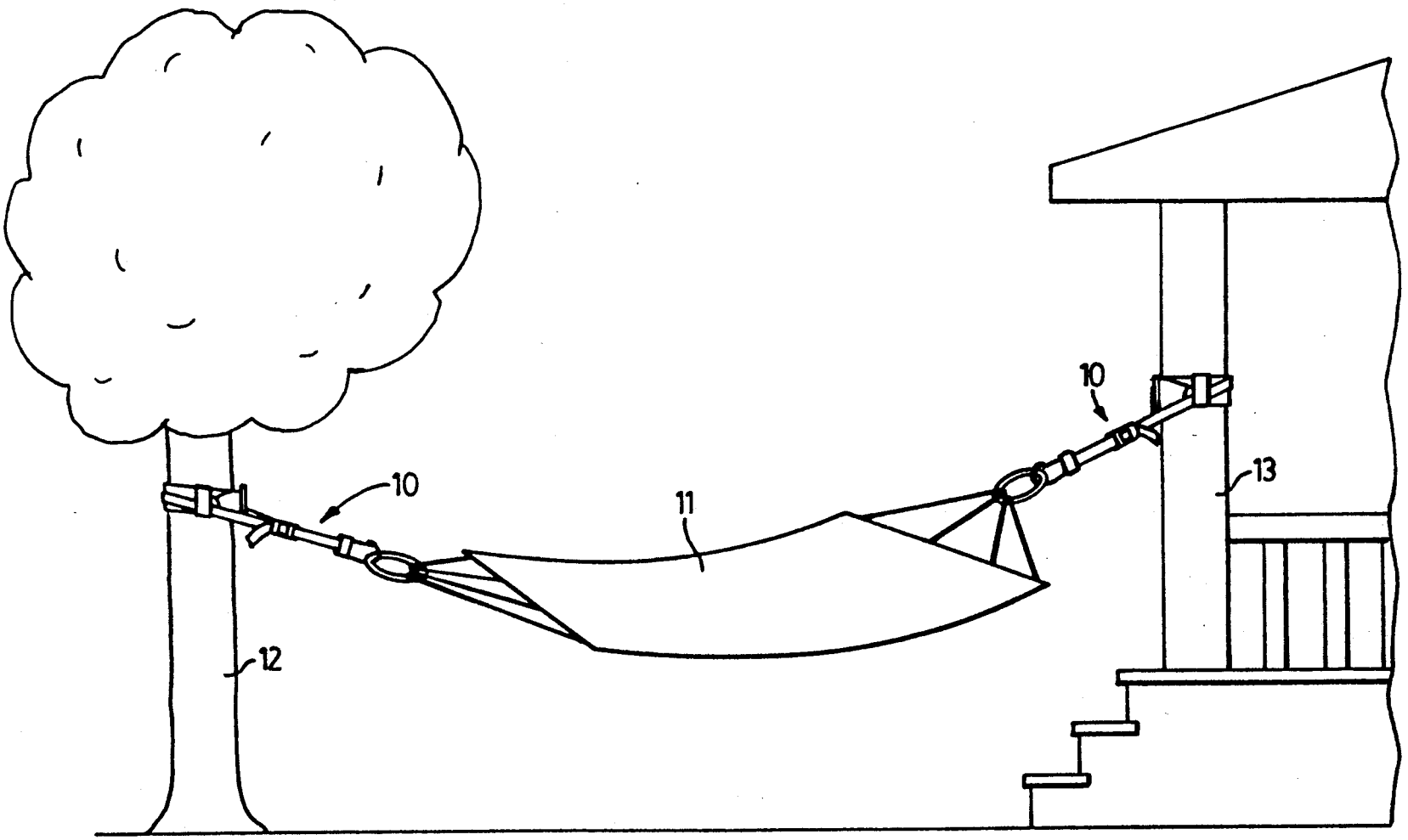
FIG. 1 is a perspective view of the preferred embodiment of the suspension device of the subject invention shown suspending a hammock between a tree and a porch.
Figure 2:
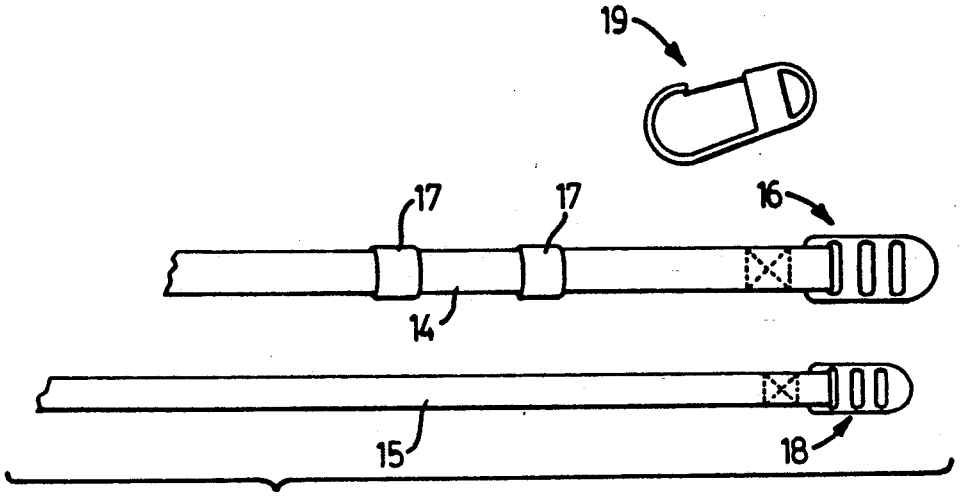
FIG. 2 is an elevational view of the components of the subject of the suspension device.

FIG. 1 shows two of the subject suspension devices 10 supporting a hammock 11 between a tree 12 and a porch post 13. As shown in FIG. 2, suspension device 10 comprises gripping belt 14, spanning belt 15, a pair of belt loops 17, belt closures 16, 18 and securing means 19.

Figure 4:
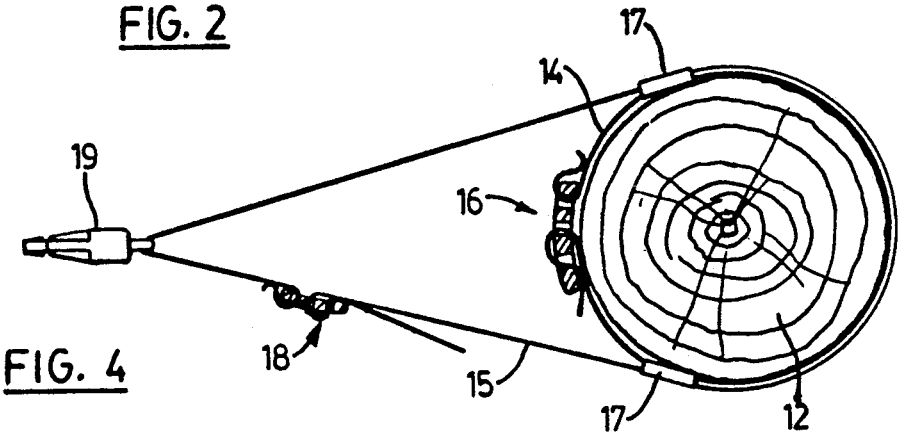
FIG. 4 is a sectional view of the subject suspension device taken along line 4—4 of FIG. 3.
Figure 3:
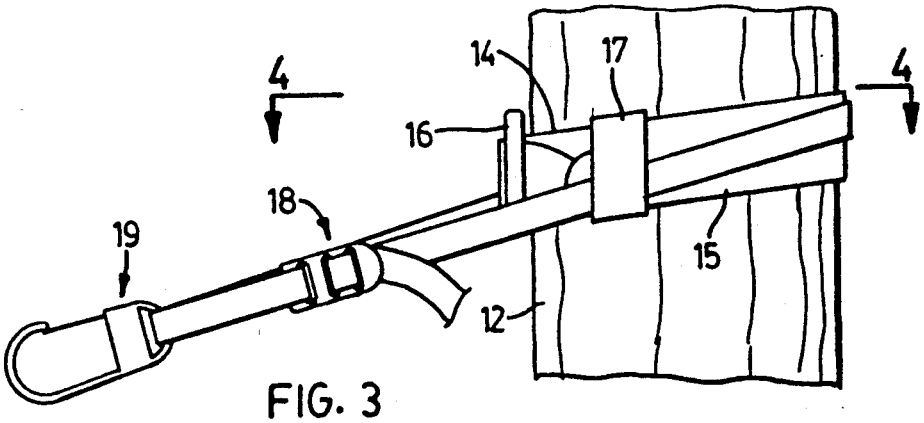
FIG. 3 is a side elevational view of the subject suspension device shown cinched around a tree.

Referring now to FIGS. 3 and 4, gripping belt 14 is dimensioned to fit around tree 12 and cinched by belt closure 16. Belt closure 16 is preferably aligned so that it faces hammock 11 to be suspended. Belt loops 17 are slid onto gripping belt 14 and are preferably placed at 10 o'clock and 2 o'clock respectively with belt closure 16 being at 12 o'clock. Belt loops 17 and belt closure 16 can be set up in other ways, but the aforementioned way has proven most effective. Spanning belt 15 is threaded through two belt loops 17 that hang on gripping belt 14 and then is formed into a closed circuit by belt closure 18 which preferably encircles tree 12 or porch post 13. The length of the spanning belt 15 can be adjusted at belt closure 18 to accomodate varying spans from hammock 11 to the tree 12 that gripping belt 14 is cinched around. Securing means 19 secures spanning belt 15 to hammock 11 or other article meant to be suspended by suspension device 10.

Belt loops 17 support spanning belt 15 and are held in place by the friction that gripping belt 14 creates when cinched against tree 12 or similar load bearing member.

Gripping belt 14 is made of a material of sufficent strength and quality to support the load in hammock 11. The material of gripping belt 14 must also be sufficiently pliable to be able to conform to the shape of regular and irregular shaped load bearing members. This allows suspension device 10 to be attached to things like porch post 13, tree 12 or branches thereof. Gripping belt 14 is preferably made of polypropylene, nylon or polyester. Belt closures 16 and 18 are preferably FASTEX® buckles or the like, but other types of closures could be utilized as long as they are able to hold gripping belt 14 and spanning belt 15 when pulled tight. Belt closure 16 is preferably attached to one end of gripping belt 14 as is shown in FIG. 2. This configuration saves time since only one end of gripping belt 14 needs to be fed through belt closure 16.

Belt loops 17 couple spanning belt 15 to gripping belt 14 and need to be of sufficient combined strength to support the load placed on hammock 11. Preferably a pair of diametrically opposed belt loops are utilized, but more or less loops could be used and their positioning does not have to be diameterically opposed. As well, other types of belt coupling means could be used, such as a single sleeve slideably received on the gripping belt through which the spanning belt is fed. Alternatively, the means for coupling the spanning belt 15 to the gripping belt 14 could comprise hooks attached to the gripping belt 14 which are designed to extend through grommets in the spanning belt 15.

Spanning belt 15 is preferably of a longer length than gripping belt 14, but that is strictly to save costs and for convenience; it need not be so. Belt closure 18 is preferably similar to belt closure 16, and must also be able to hold spanning belt 15, when pulled to the desired tension. As with gripping belt 14 and belt closure 16 the same configuration is used, but again only for maximum efficency and convenience.

Belts 14 and 15 can be of different widths and it is so desired to achieve maximum results for minimum costs. Preferably spanning belt 15 can be of a lesser width than gripping belt 14, with 2 inches for the gripping belt 14 and 1 inch for the spanning belt 15 being the desired dimensions. However, the belts could be of any widths. Gripping belt 14 must be wide enough to provide a sufficient surface area so that when cinched around a load bearing member will provide the necessary friction to keep the suspension device 10 from slipping under the load strain. Spanning belt 15 does not need the same surface area as gripping belt 14 as its function is to span the distance between hammock 11 and the load bearing members such as tree 12, and no gripping properties are necessary. Hence, it is desired that spanning belt 15 be of a sufficient length, without becoming cumbersome, to span potentially large distances where it may be desired to suspend an article.

As shown, securing means 19 is a snaphook or clip which must be slid onto spanning belt 15 before it is fastened by closure 18. Alternatively, securing means 19 could be an S hook, a ring and hook assembly, a clip design, or the like.

To use suspension device 10 to suspend hammock 11 as shown in FIG. 1, select a location where potential load bearing members are within the range of the spanning belts 15. Thread the belt loops 17 onto the gripping belt 14, cinch the gripping belt 14 around the load bearing member with belt loops 17 at 2 o'clock and 10 o'clock respective of the article to be suspended being at 12 o'clock. Thread spanning belt 15 through belt loops 17 and around the load bearing member, thread on snaphook 19 and complete the circuit by closing belt closure 18. Clip snaphook 19 to hammock 11 and adjust spanning belt 15 to desired tension. In this application, two suspension devices 10 would be used, one for each end of hammock 11. It should be appreciated that the suspension device 10 can be suspended from non-vertical members such as tree boughs that hang horizontally. And, of course, one or more of the suspension device 10 could be used to suspend articles other than hammock 11, such as tarpaulins.

The term "belt" used in this application is intended to be a generic term for all belts, ropes, cords, and other such elongated flexible members.

It should be understood that various changes may be made to the preferred embodiment of the invention described herein, without departing from the scope of the subject invention, which is defined in the following claims.

I claim:

1. A suspension device for suspending a hammock or other inanimate object from a load bearing member, comprising:

a) gripping means for gripping a load bearing member, wherein the gripping means comprises a gripping belt of determinate length to fit around the load bearing member, and cinching means for releasably cinching the gripping belt around the member;

b) spanning means for spanning the distance between the object and the load bearing member, wherein the spanning means comprises a spanning belt;

c) belt coupling means for releasably coupling the spanning means to the gripping means around the member, wherein the belt coupling means comprises a pair of belt loops dimensioned to be slideably received on the gripping belt and to slideably receive the spanning belt; and d) securing means for securing the spanning means to the object to be suspended.

2. The suspension device as defined in claim 1, wherein the spanning belt is provided with closure means for selectively forming the spanning belt into a closed circuit of adjustable length for encircling the load bearing member.

3. The suspension device as defined in claim 2, wherein the closure means comprises a buckle for adjusting the length of the spanning belt.

4. The suspension device as defined in claim 2, wherein the cinching means comprises a quick release, non-slipping, adjustable buckle adapted to adjust the length of the gripping belt.

5. The suspension device as defined in claim 1, wherein the securing means comprises a snaphook that is slideably received on the spanning belt.

6. A suspension device for suspending a hammock or other inanimate object from a load bearing member, comprising:

a) gripping means for gripping a load bearing member;

b) spanning means for spanning the distance between the object and the load bearing member, comprising a spanning belt and closure means for selectively forming the spanning belt into a closed circuit of adjustable length for encircling the load bearing member;

c) belt coupling means for releasably coupling the spanning belt to the gripping means around the load bearing member at a minimum of one tension point;

d) securing means for securing the spanning means to the object at a contact point;

e) wherein the gripping means comprises a gripping belt of determinate length to fit around the load bearing member, and cinching means for releasably cinching the gripping belt around the member; and f) wherein the belt coupling means comprises a pair of belt loops dimensioned to be slideably received on the gripping belt and to slideably receive the spanning belt.

7. The suspension device as defined in claim 6, wherein the closure means comprises a buckle for adjusting the length of the spanning belt.

8. The suspension device as defined in claim 7, wherein the securing means comprises a snaphook that is slideably received on the spanning belt.

* * * * *